US008714417B1

(12) United States Patent
Szekely

(10) Patent No.: US 8,714,417 B1
(45) Date of Patent: May 6, 2014

(54) INJECTION MOLDED JAR WITH POUR FEATURE

(75) Inventor: Alex S. Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 96 days.

(21) Appl. No.: 13/281,511

(22) Filed: Oct. 26, 2011

Related U.S. Application Data

(60) Provisional application No. 61/411,660, filed on Nov. 9, 2010.

(51) Int. Cl.
*B65D 5/72* (2006.01)

(52) U.S. Cl.
USPC ..... 222/572; 222/1; 222/562; 264/239

(58) Field of Classification Search
USPC ..... 222/1, 551, 562, 566, 572, 462, 547, 222/575, 564; 215/41, 42, 44, 371; 220/604, 608, 659
See application file for complete search history.

(56) References Cited

U.S. PATENT DOCUMENTS

| | | | | |
|---|---|---|---|---|
| 162,117 | A | 4/1875 | Synnott | |
| D68,368 | S | 10/1925 | Bell | |
| 2,006,704 | A | 7/1935 | Muffling | |
| 2,035,877 | A | 3/1936 | Geerlings | |
| 2,059,910 | A | 11/1936 | Ravenscroft | |
| 2,132,120 | A | 10/1938 | Scheyer et al. | |
| 2,540,931 | A * | 2/1951 | Carvalho | 222/566 |
| 2,738,090 | A | 3/1956 | Davis | |
| 4,592,884 | A | 6/1986 | Thomson | |
| 4,630,761 | A | 12/1986 | Thomson | |
| 4,877,142 | A * | 10/1989 | Doering | 215/382 |
| 4,917,269 | A * | 4/1990 | Fuchs et al. | 222/109 |
| 4,949,861 | A * | 8/1990 | Cochran | 215/42 |
| 4,989,757 | A * | 2/1991 | Krall | 222/111 |
| 5,217,737 | A | 6/1993 | Gygax et al. | |
| 5,964,383 | A * | 10/1999 | Cargile | 222/571 |
| 6,059,153 | A * | 5/2000 | Olson et al. | 222/465.1 |
| 6,085,949 | A | 7/2000 | Zimny et al. | |
| 7,207,466 | B2 * | 4/2007 | Walsh et al. | 222/111 |

* cited by examiner

*Primary Examiner* — Kevin P Shaver
*Assistant Examiner* — Patrick M Buechner
(74) *Attorney, Agent, or Firm* — Bachman & LaPointe, P.C.

(57) ABSTRACT

A jar body is unitarily formed as a single piece and includes an externally-threaded neck having a rim defining a jar mouth. A main body has a sidewall and a base. A shoulder extends outward from an upper end of the main body to couple the main body to the neck. An interior pour channel is formed along the neck.

20 Claims, 2 Drawing Sheets

INJECTION MOLDED JAR WITH POUR FEATURE

CROSS-REFERENCE TO RELATED APPLICATION

Benefit is claimed of U.S. Patent Application Ser. No. 61/411,660, filed Nov. 9, 2010, and entitled "Injection-Molded Jar with Pour Feature", the disclosure of which is incorporated by reference herein in its entirety as if set forth at length.

BACKGROUND OF THE INVENTION

The invention relates to molded containers. More particularly, the invention relates to molded plastic jars.

A variety of molded plastic jar configurations exist. Molding techniques include blow molding and injection molding. Blow-molded jars typically have bodies that are wider than their associated threaded necks.

SUMMARY OF THE INVENTION

One aspect of the invention involves a jar body unitarily formed as a single piece. A piece includes an externally threaded neck having a rim defining a jar mouth. A jar main body has a sidewall and a base. A shoulder extends outward from an upper end of the main body to couple the main body to the neck. An interior pour channel is formed along the neck.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 6:
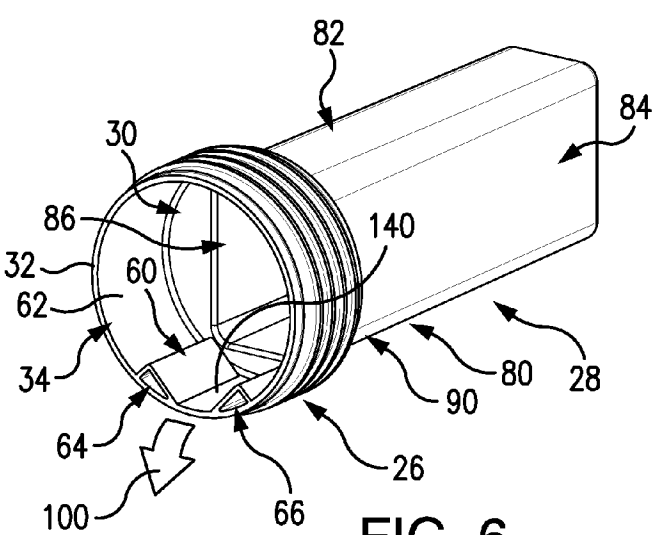
FIG. 6 is a view of a body of the jar of FIG. 1.

FIGS. 1-5 show a jar 20 having a body 22 and a cap 24. The jar body and cap share a central longitudinal axis 500. The exemplary body-to-cap interaction is a threaded engagement, although alternative snap-on engagements may be possible. The body (FIG. 6) is formed as the unitarily-molded single-piece combination of: a neck 26; a main body 28; and a shoulder 30. With reference to an upright condition, the main body and neck share an upper rim 32 which defines a jar mouth 34. An exterior surface 36 (FIG. 8) of the neck bears an external thread 38. A lower end 39 of the neck joins with an outer periphery 40 of the shoulder 30. An inner periphery 42 (FIG. 9) of the shoulder joins with an upper end 44 of the main body.

The main body includes a sidewall 46 depending from the upper end 44 and extending to a lower end 48 at the periphery 50 of a base 52.

An interior pour channel 60 (FIG. 6) is formed along the neck. The exemplary pour channel or spout 60 is formed along an inboard surface 62 of the neck by a first sidewall 64 and a second sidewall 66. The first and second sidewalls each extend from an upper end 68 (FIG. 9) essentially coplanar with the rim 32 to a lower end joining the shoulder along an upper/interior surface 70 of the shoulder.

Figure 8:
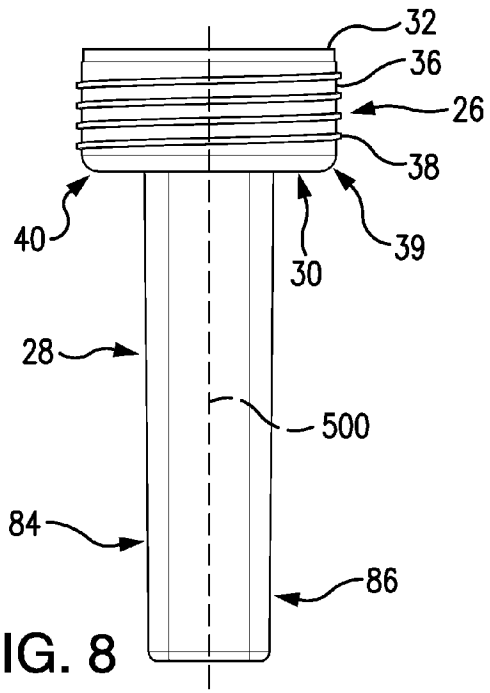
FIG. 8 is a side view of the jar body of FIG. 6.

The exemplary main body cross-section transverse to the axis 500 is essentially rectangular (e.g., giving the clear appearance of being rectangular while having slightly rounded corners appropriate for manufacturability (such as permitting material flow during molding and limiting stress concentrations)). The exemplary main body 28 rectangular cross-section has a shorter pair of sides 80, 82 (FIG. 9) and a longer pair of sides 84, 86 (FIG. 8). Alternative cross-sections are possible.

Figure 7:
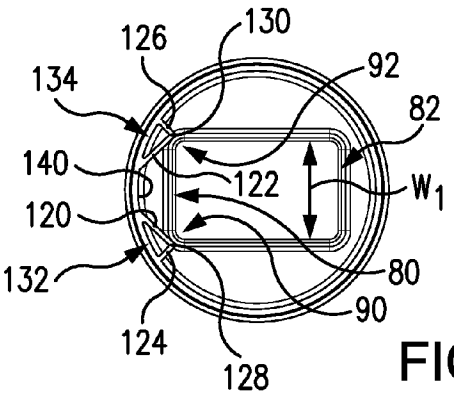
FIG. 7 is a top view of the jar body of FIG. 6.

The exemplary channel/spout first and second sidewalls 64, 66 are dimensioned to meet the cross-section of the main body 28 at the shoulder 30. In the exemplary implementation, they meet an adjacent pair of corners 90, 92 (FIG. 7) of the rectangular cross-section separated by one of the shorter sides 80 or 82 (80 as illustrated). This allows the channel/spout 60 between the sidewalls to guide flow from the main body 28 during a pouring operation.

The presence of the channel/spout 60 allows for a pour 100 (FIG. 6—e.g., of liquid or particles) narrower than what would be obtained from a similar diameter neck/mouth without such a channel 60. This may be particularly useful when pouring the contents of the jar into another container having a narrow mouth (e.g., a blow-molded squirt bottle having a mouth inner diameter much less than an inner diameter D (FIG. 9) of the present mouth (e.g., less than 70% of D or less than 50% of D)). Such a jar 20 may replace a baseline bottle which has a narrower neck/mouth. For example, the baseline bottle may be a blow-molded bottle having a neck/mouth which is narrower than a main body. Such a blow-molded bottle may be more expensive to manufacture than the injection-molded jar. Exemplary D is 2-5 cm. Along all or a majority of a height of the main body, interior exemplary inner widths $W_1$ and $W_2$ between the longer and shorter sides of the main body are less than 90% of D. With the rectangular section, exemplary $W_1$ is 50-80% of $W_2$ along such entirety or majority.

Each of the exemplary channel/spout sidewalls 64 and 66 is formed with a V-shaped cross-section formed by and defining an inner wall 120, 122 (FIG. 7) along the channel and an outer wall 124, 126 laterally (e.g., circumferentially) outboard thereof. In each sidewall, the inner wall and outer wall merge at an associated junction/vertex/apex 128, 130 which forms a rim of the channel sidewall. Each inner and outer wall merges with the circumferential wall portion of the neck to leave an interior space or gap 132, 134. The exemplary gap 132, 134 has a near triangular cross-section.

The exemplary channel 60 tapers (narrows) from its sidewall rims toward its base. For example, a channel width at the rims 128, 130 is essentially similar to the width of the narrower sides of the bottle main body 28 at the shoulder 30. The exemplary inner walls 122, 124 taper at a shallow angle so that a width at a base 140 of the channel (along the circumferential wall portion) is much narrower than the width at the rims (e.g., <75% or an exemplary 25-60% or 30-50%). For strength of the sidewalls, the outer walls 124, 126 are more nearly normal to the circumferential wall portion.

Figure 1:
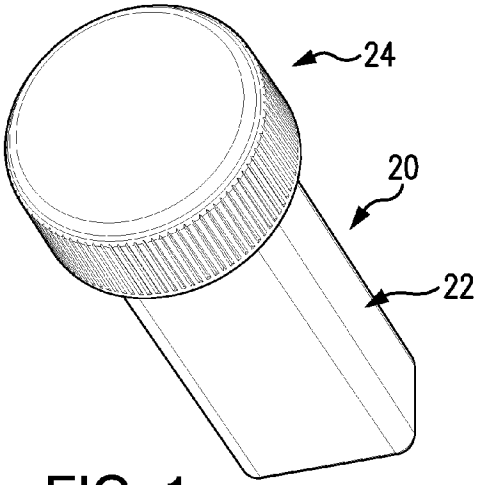
FIG. 1 is a view of a jar.
Figure 2:
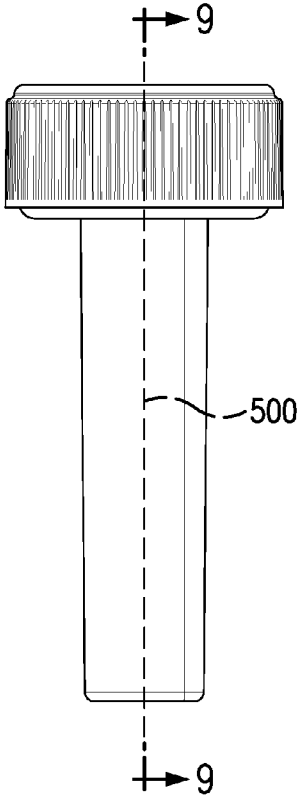
FIG. 2 is a side view of the jar of FIG. 1.
Figure 3:
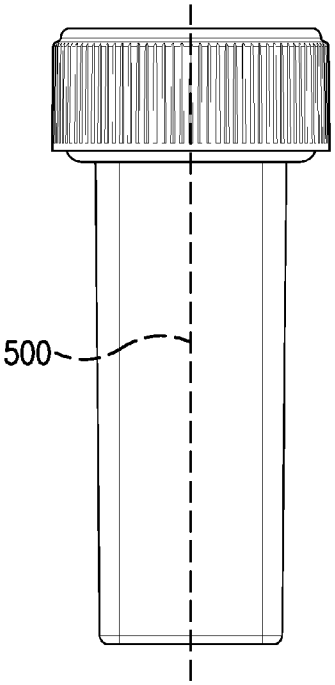
FIG. 3 is a front view of the jar of FIG. 1.
Figure 4:
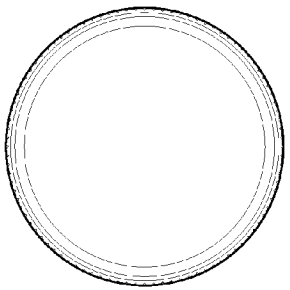
FIG. 4 is a top view of the jar of FIG. 1.
Figure 5:
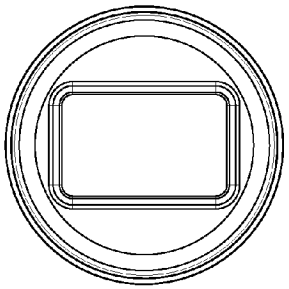
FIG. 5 is a bottom view of the jar of FIG. 1.
Figure 9:
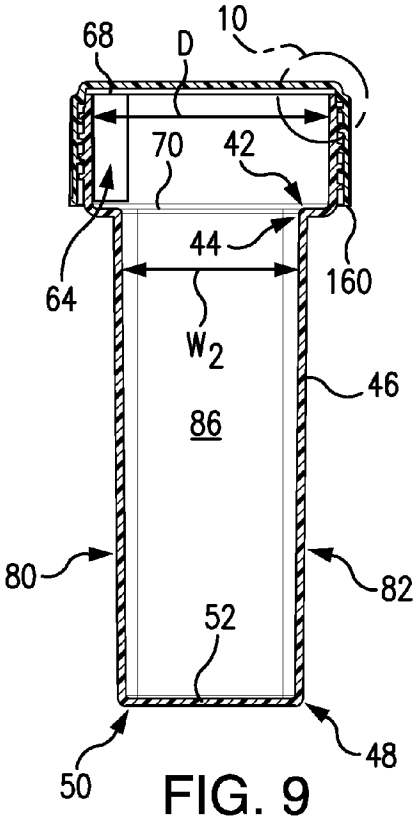
FIG. 9 is a central vertical sectional view of the jar of FIG. 2, taken along line 9-9.
Figure 10:
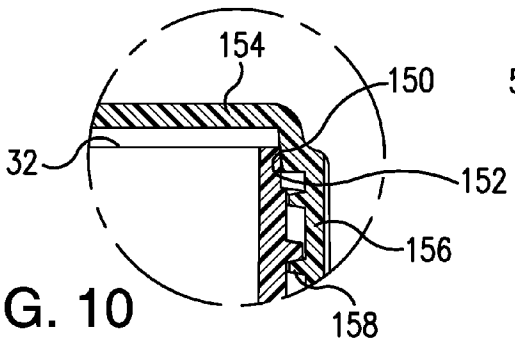
FIG. 10 is an enlarged view of a mouth portion of the jar of FIG. 9.

FIG. 10 shows sealing between the cap and body. The exemplary sealing is shown as an interference between an uppermost portion 150 of the surface 36 (stepped slightly inward from a remainder thereof) with an inboard surface portion 152 of the cap. The exemplary inboard surface 152 is along a junction between an upper web 154 of the cap and a depending sidewall 156 which bears the internal thread 158. The sidewall 156 extends to a lower rim 160 (FIG. 9).

The exemplary jar body 20 may be formed by injection molding of a plastic material (e.g., polyethylene or polypropylene compatible with the product for chemical resistance). The exemplary cap may similarly be injection molded of polyethylene or polypropylene.

In the injection molding process, the interior of the jar may be defined by one or more die cores (or pulls). The core(s) may include portions respectively forming the interior spaces 132, 134 between the walls of each sidewall. There may be a single such core that molds the entire body interior. Relative to a single thin channel sidewall (e.g., a radial web) the double-wall sidewalls provide increased robustness.

An exemplary of such use is in a hair coloring system wherein a colorant is sold/stored in the jar and, for each hair coloring treatment, the appropriate dose portion is transferred into a squeeze/squirt applicator bottle.

One or more embodiments of the present invention have been described. Nevertheless, it will be understood that various modifications may be made without departing from the spirit and scope of the invention. For example, details of particular end uses may influence details of particular implementations. Accordingly, other embodiments are within the scope of the following claims.

What is claimed is:

1. A jar body comprising the unitary single-piece combination of:

an externally-threaded (38) neck (26) having a rim (32) defining a jar mouth (34);

a main body (28) having a sidewall (46) and a base (50);

a shoulder (30) extending radially outward from an upper end of the main body to couple the main body to the neck; and an interior pour channel (60) formed by a first sidewall (64) and a second sidewall (66) along an externally-threaded portion of the neck.

2. The jar body of claim 1 wherein:

the first and second sidewalls join the shoulder.

3. The jar body of claim 2 wherein:

the main body has a generally rectangular cross-section; and the first and second sidewalls are aligned with an adjacent pair of corners of said rectangular cross-section.

4. The jar body of claim 3 wherein:

along a majority of a height of the main body, an interior width between the longer sides of the main body cross-section is 50-80% of an interior width between the shorter sides of the main body cross-section.

5. The jar body of claim 3 wherein:

both interior dimensions of the generally rectangular cross-section are less than an inner diameter of the neck.

6. The jar body of claim 2 wherein:

the first and second sidewalls are each formed with a V-shaped cross-section defining an inner wall along the channel and an outer wall; and for each of the first and second sidewalls there is a gap between the inner wall, the outer wall, and a circumferential wall portion of the neck, which circumferential wall portion bears the external thread.

7. The jar body of claim 1 wherein:

an internal diameter of the neck is 2-5 cm.

8. The jar body of claim 1 injection molded of polyethylene or polypropylene.

9. A jar comprising:

the jar body of claim 1; and an internally-threaded cap engaged to the externally-threaded neck.

10. The combination comprising:

the jar of claim 9; and a liquid within the main body.

11. A method for using the jar of claim 9, the method comprising:

unthreading the cap;

tilting the jar to pour liquid contents of the jar, wherein:

during the pouring, the pour channel guides the pour flow along the neck.

12. A method for manufacturing the jar body of claim 1, the method comprising:

injection molding said jar body as said unitary single-piece combination.

13. The method of claim 12 wherein:

the first and second sidewalls are each formed with a V-shaped cross-section defining an inner wall along the channel and an outer wall; and during the molding, one or more die cores include portions respectively forming interior spaces between walls of each sidewall.

14. The jar body of claim 1 wherein:

the channel extends between the rim and the shoulder.

15. The jar body of claim 1 wherein:

the channel has a lower end joining the shoulder.

16. The jar body of claim 1 wherein:

the channel is configured to provide a narrower pour than would otherwise be present.

17. The jar body of claim 1 wherein:

the first sidewall and the second sidewall extend between the rim and the shoulder.

18. The jar body of claim 1 wherein:

the first sidewall and the second sidewall each have a lower end joining the shoulder.

19. A jar body comprising the unitary single-piece combination of:

an externally-threaded (38) neck (26) having a rim (32) defining a jar mouth (34);

a main body (28) having a sidewall (46) and a base (50);

a shoulder (30) extending outward from an upper end of the main body to couple the main body to the neck; and an interior pour channel (60) formed along the neck, wherein:

the first and second sidewalls join the shoulder;

the first and second sidewalls are each formed with a V-shaped cross-section defining an inner wall along the channel and an outer wall; and for each of the first and second sidewalls there is a gap between the inner wall, the outer wall, and a circumferential wall portion of the neck, which circumferential wall portion bears the external thread.

20. A jar body comprising the unitary single-piece combination of:

an externally-threaded (38) neck (26) having a rim (32) defining a jar mouth (34);

a main body (28) having a sidewall (46) and a base (50);

a shoulder (30) extending outward from an upper end of the main body to couple the main body to the neck; and an interior pour channel (60) formed along the neck, wherein:

the first and second sidewalls join the shoulder;

the main body has a generally rectangular cross-section;

the first and second sidewalls are aligned with an adjacent pair of corners of said rectangular cross-section; and both interior dimensions of the generally rectangular cross-section are less than an inner diameter of the neck.

* * * * *